US011283217B2

(12) United States Patent
Montena et al.

(10) Patent No.: US 11,283,217 B2
(45) Date of Patent: Mar. 22, 2022

(54) TORQUE-LIMITING TORQUE SLEEVE WITH FAIL-SAFE FAILURE MODE

(71) Applicant: PPC Broadband, Inc., East Syracuse, NY (US)

(72) Inventors: Noah P. Montena, Syracuse, NY (US); Jeremy J. Amidon, Raleigh, NC (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 17/002,575

(22) Filed: Aug. 25, 2020

(65) Prior Publication Data

US 2020/0388957 A1 Dec. 10, 2020

Related U.S. Application Data

(63) Continuation of application No. 15/627,416, filed on Jun. 19, 2017, now Pat. No. 10,756,483.

(60) Provisional application No. 62/351,760, filed on Jun. 17, 2016.

(51) Int. Cl.

| | |
|---|---|
| ***H01R 9/05*** | (2006.01) |
| ***H01R 13/622*** | (2006.01) |
| ***B25B 23/14*** | (2006.01) |
| *H01R 24/52* | (2011.01) |

(52) U.S. Cl.

CPC ..... *H01R 13/622* (2013.01); *B25B 23/141* (2013.01); *H01R 9/05* (2013.01); *H01R 24/525* (2013.01)

(58) Field of Classification Search

CPC ..... H01R 13/622; H01R 2103/00; H01R 13/6215; H01R 13/635; F16B 31/02; B25B 13/48

USPC ..... 439/320, 322, 578, 362, 923; 411/7; 81/124.2

See application file for complete search history.

(56) References Cited

U.S. PATENT DOCUMENTS

| | | | | |
|---|---|---|---|---|
| 3,425,314 | A * | 2/1969 | Ohlson | F16B 31/02 411/7 |
| 5,297,458 | A | 3/1994 | Smith et al. | |
| 5,456,614 | A | 10/1995 | Szegda | |
| 6,252,170 | B1 | 6/2001 | Korinek | |
| 6,364,688 | B1 | 4/2002 | Fraley, II et al. | |
| 6,802,680 | B1 | 10/2004 | Rubenstein | |
| 6,817,272 | B2 | 11/2004 | Holland | |

(Continued)

OTHER PUBLICATIONS

Search Report dated Aug. 25, 2017 in corresponding International Application No. PCT/US2017/038198, 2 pages.

(Continued)

*Primary Examiner* — Thanh Tam T Le

(74) *Attorney, Agent, or Firm* — MH2 Technology Law Group LLP

(57) ABSTRACT

A torque-limiting torque sleeve may include an inner sleeve and an outer sleeve configured to be coupled to one another in a coaxial arrangement such that the outer sleeve is fixed relative to the inner sleeve in the longitudinal direction. A first end of the outer sleeve overlies a first end of the inner sleeve, and a second end of the inner sleeve extends from the outer sleeve. A torque limiting feature is configured such that rotation of the outer member in a first direction enables tightening of a coupler on an interface port up to a predetermined torque limit, and rotation of the outer member in a second direction opposite to the first direction loosens the coupler on the interface port.

21 Claims, 11 Drawing Sheets

(56) References Cited

U.S. PATENT DOCUMENTS

| | | | | |
|---|---|---|---|---|
| 6,843,627 | B2 | 1/2005 | Childs et al. | |
| 6,951,481 | B2 | 10/2005 | Dykstra et al. | |
| 7,445,414 | B1 | 11/2008 | Notaro | |
| 7,837,501 | B2 * | 11/2010 | Youtsey | H01R 24/40 439/578 |
| 7,892,005 | B2 | 2/2011 | Haube | |
| 8,291,795 | B2 * | 10/2012 | Hughes | F16B 23/0038 81/460 |
| 8,490,525 | B2 | 7/2013 | Wilson et al. | |
| 8,568,164 | B2 | 10/2013 | Ehret et al. | |
| 8,568,167 | B2 | 10/2013 | Montena | |
| 8,764,361 | B2 * | 7/2014 | Seaman | F16B 31/02 411/7 |
| 8,973,728 | B1 | 3/2015 | Fork | |
| 9,028,276 | B2 * | 5/2015 | Wilson | H01R 9/05 439/578 |
| 10,100,864 | B2 | 10/2018 | Rathmann et al. | |
| 10,756,483 | B2 * | 8/2020 | Montena | B25B 23/141 |
| 2009/0133980 | A1 | 5/2009 | Swaim et al. | |
| 2010/0199813 | A1 | 8/2010 | Phillips et al. | |
| 2014/0123819 | A1 | 5/2014 | Beemer et al. | |

OTHER PUBLICATIONS

Written Opinion dated Aug. 25, 2017 in corresponding International Application No. PCT/US2017/038198, 4 pages.

International Preliminary Report on Patentability dated Dec. 18, 2018 in corresponding International Application No. PCT/US2017/038198, 5 pages.

* cited by examiner

TORQUE-LIMITING TORQUE SLEEVE WITH FAIL-SAFE FAILURE MODE

TECHNICAL FIELD

The disclosure is directed to an accessory device attachable to a connector which improves the ability of an unskilled user to securely fasten a connector to an equipment port using only their fingers, while preventing over-tightening and preventing the failure of the device from rendering the connector coupling inoperable.

BACKGROUND

Some conventional accessory torque assisting sleeves may provide a user with a more ergonomic grip when fastening a drop connector to an equipment interface port, such as those on the back of a TV or set-top box, or to a wall jack. Some conventional accessory torque assisting sleeves may improve a user's ability to hand-tighten a connector to an equipment interface port, such as those on the back of a TV or set-top box, or to a wall jack. However, conventional accessory torque assisting sleeves lack any indication to the user as to whether or not the connector is sufficiently secure, save for a rise in the amount of torque felt through the fingertips. Conventional accessory torque assisting sleeves do not typically prevent an overzealous user from over-tightening the connector and causing damage.

Some conventional accessory torque sleeves incorporate torque-limiting mechanisms, but these conventional accessory torque sleeves render the connector coupler inoperable if the torque limiting mechanism becomes damaged, which would make it nearly impossible to remove the connector from the equipment interface port or wall jack once it has been attached.

Accordingly, there is a need to overcome, or otherwise lessen the effects of, the disadvantages and shortcomings described above. Hence a need exists for a torque limiting sleeve that provides access to the coupler to permit removal of the connector from the interface port should the torque limiting mechanism fail due to abuse, weather, tampering, or other causes. In this regard, it may be desirable to provide a torque limiting mechanism having a sleeve directly coupled to the nut and having a substantial length of the sleeve left exposed, so that if the torque limiting mechanism becomes inoperable, the sleeve (and therefore the nut) are still accessible and may be manipulated just as with any standard non-torque-limiting sleeve. A need may exist for a torque limiting sleeve that provides haptic feedback to a user when the coupler of the connector is tightened to a predetermined torque limit.

SUMMARY

According to various aspects of the disclosure, a torque-limiting torque sleeve may include an inner sleeve and an outer sleeve configured to be coupled to one another in a coaxial arrangement such that the outer sleeve is fixed relative to the inner sleeve in the longitudinal direction. A first end of the outer sleeve overlies a first end of the inner sleeve, and a second end of the inner sleeve extends from the outer sleeve to provide an exposed length. A torque limiting feature may be configured such that rotation of the outer member in a first direction enables tightening of a coupler on an interface port up to a predetermined torque limit, and rotation of the outer member in a second direction opposite to the first direction loosens the coupler on the interface port.

In the event that the torque limiting feature fails such that rotation of the outer member in the first and second directions does not tighten or loosen the coupler on the interface port, the exposed length of the inner member is grippable by a user to tighten or loosen the coupler on the interface port.

In some aspects, the inner sleeve is configured to be coupled with a coupler of a connector, the inner sleeve has a first length, and the outer sleeve has a second length that is less than the first length in a longitudinal direction.

According to various aspects, at least one of the inner and outer sleeves includes a structure that maintains the outer sleeve at a fixed position relative to the inner sleeve in the longitudinal direction.

In various aspects, the torque limiting feature includes a torque limiting structure on at least one of the inner and outer sleeves that enables tightening of the coupler on the interface port up to the predetermined torque limit.

In some aspects, after the coupler is coupled to the interface port with a torque at the predetermined torque limit, the outer member is configured to rotate relative to the inner member to prevent over tightening of the coupler on the interface port.

In some aspects, the outer member and the inner member are configured to rotate together with one another in a second direction opposite to the first direction.

In accordance with various aspects of the disclosure, a torque-limiting torque sleeve may include an inner sleeve having a first length and an outer sleeve configured to be coupled with the inner sleeve in a coaxial arrangement. The outer sleeve may have a second length less than the first length in a longitudinal direction. The inner and outer sleeves may be configured to be coupled to one another such that the outer sleeve is fixed relative to the inner sleeve in the longitudinal direction, a first end of the outer sleeve overlies a first end of the inner sleeve, and a second end of the inner sleeve extends from the outer sleeve to provide an exposed length. A torque limiting feature may be configured such that rotation of the outer member in a first direction enables tightening of the coupler on an interface port up to a pre-determined torque limit, and rotation of the outer member in a second direction opposite to the first direction loosens the coupler on the interface port. In the event that the torque limiting feature fails such that rotation of the outer member in the first and second directions does not tighten or loosen the coupler on the interface port, the exposed length of the inner member is grippable by a user to tighten or loosen the coupler on the interface port.

In some aspects, the inner sleeve is configured to be coupled with a coupler of a connector.

According to various aspects, the inner and outer sleeves include cooperative structures that keep the outer sleeve at a fixed position relative to the inner sleeve in the longitudinal direction.

According to some aspects, the torque limiting feature includes torque limiting structures on the inner and outer sleeves that cooperate with one another such that the rotation of the outer member in the first direction enables tightening of the coupler on the interface port up to the predetermined torque limit.

In various aspects, after the coupler is coupled to the interface port with a torque at the predetermined torque limit, the outer member is configured to rotate relative to the inner member to prevent over tightening of the coupler on the interface port.

In some aspects, the outer member and the inner member are configured to rotation together with one another in a second direction opposite to the first direction.

According to various aspects of the disclosure, a torque limiting torque sleeve may include an inner sleeve and an outer sleeve configured to be coupled to one another in a coaxial arrangement. The inner sleeve has a first end configured to be coupled with a nut of a connector and has a first length L1 that is greater than a second length L2 of the outer sleeve. When the inner and outer sleeves are coupled to one another, a first end of the outer sleeve overlies the first end of the inner sleeve, and a second end of the inner sleeve extends from the outer sleeve to provide an exposed length L3. The inner and outer sleeves include cooperative structures that keep the outer sleeve fixed to the inner sleeve in a longitudinal direction. The inner and outer sleeves further include torque limiting features that cooperate with one another such that rotation of the outer member in a first direction TL enables tightening of the coupler up to a pre-determined torque limit, after which the outer member is configured to rotate relative to the inner member to prevent over tightening. The outer member and the inner member are fixed for rotation in a first direction F opposite to the first direction TL. In the event that one or both of the torque limiting features becomes damaged, deformed, or defective such that rotation of the outer member in the first and second directions does not tighten or loosen the coupler on the interface port, the exposed length L3 of the inner member is grippable by a user to tighten or loosen the nut on the interface port.

BRIEF DESCRIPTION OF THE DRAWINGS

Features and advantages of the present disclosure are described in, and will be apparent from, the following Brief Description of the Drawings and Detailed Description.

DETAILED DESCRIPTION

Figure 1:
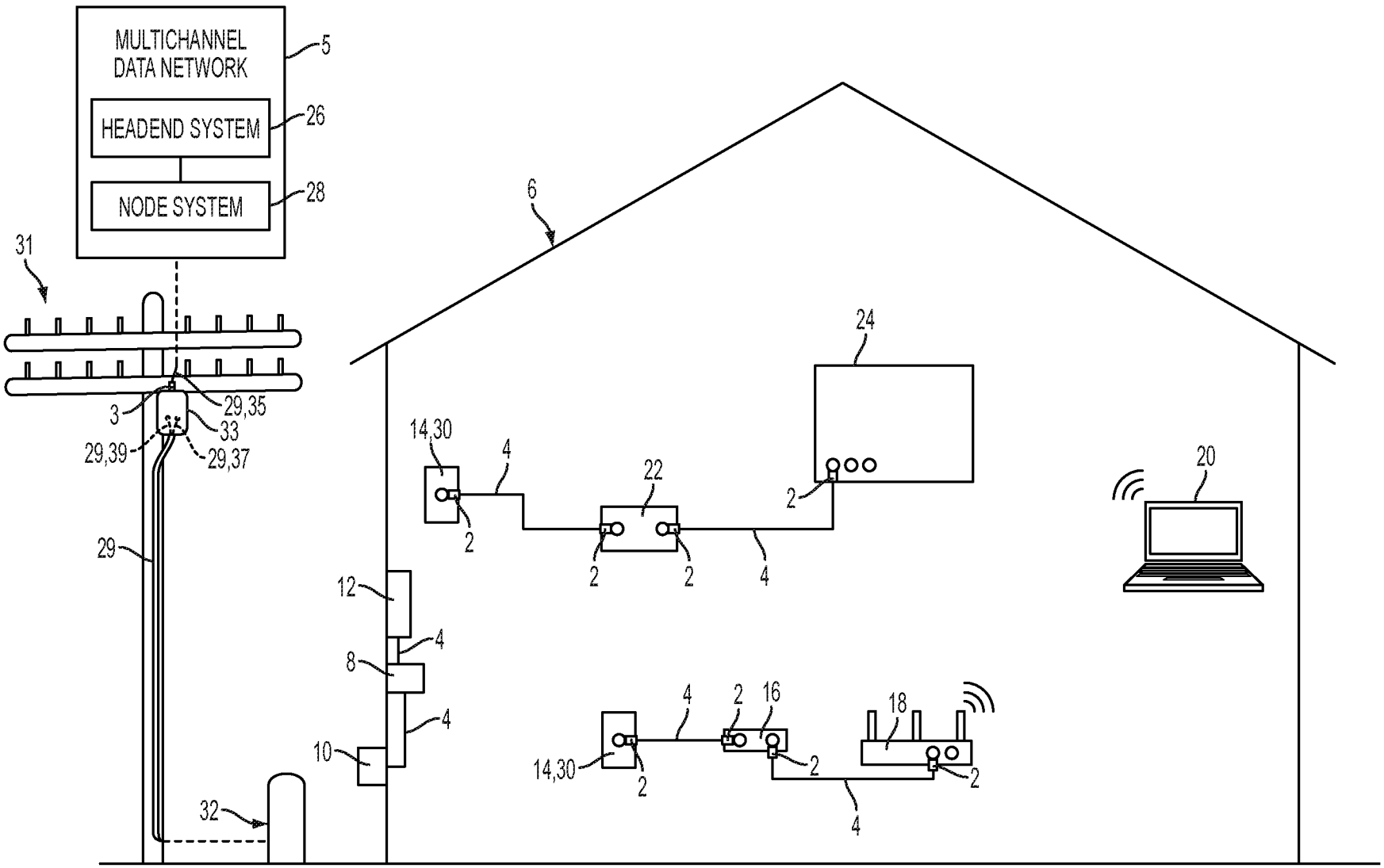
FIG. 1 is a schematic view of an exemplary network environment in accordance with various aspects of the disclosure.

Referring to FIG. 1, cable connectors 2 and 3 enable the exchange of data signals between a broadband network or multichannel data network 5, and various devices within a home, building, venue or other environment 6. For example, the environment's devices can include: (a) a point of entry ("PoE") filter 8 operatively coupled to an outdoor cable junction device 10; (b) one or more signal splitters within a service panel 12 which distributes the data service to interface ports 14 of various rooms or parts of the environment 6; (c) a modem 16 which modulates radio frequency ("RF") signals to generate digital signals to operate a wireless router 18; (d) an Internet accessible device, such as a mobile phone or computer 20, wirelessly coupled to the wireless router 18; and (e) a set-top unit 22 coupled to a television ("TV") 24. In one embodiment, the set-top unit 22, typically supplied by the data provider (e.g., the cable TV company), includes a TV tuner and a digital adapter for High Definition TV.

In some embodiments, the multichannel data network 5 includes a telecommunications, cable/satellite TV ("CATV") network operable to process and distribute different RF signals or channels of signals for a variety of services, including, but not limited to, TV, Internet and voice communication by phone. For TV service, each unique radio frequency or channel is associated with a different TV channel. The set-top unit 22 converts the radio frequencies to a digital format for delivery to the TV. Through the data network 5, the service provider can distribute a variety of types of data, including, but not limited to, TV programs including on-demand videos, Internet service including wireless or WiFi Internet service, voice data distributed through digital phone service or Voice Over Internet Protocol ("VoIP") phone service, Internet Protocol TV ("IPTV") data streams, multimedia content, audio data, music, radio and other types of data.

In some embodiments, the multichannel data network 5 is operatively coupled to a multimedia home entertainment network serving the environment 6. In one example, such multimedia home entertainment network is the Multimedia over Coax Alliance ("MoCA") network. The MoCA network increases the freedom of access to the data network 5 at various rooms and locations within the environment 6. The MoCA network, in one embodiment, operates on cables 4 within the environment 6 at frequencies in the range of 1125 MHz to 1675 MHz. MoCA compatible devices can form a private network inside the environment 6.

As described above, the data service provider uses coaxial cables 29 and 4 to distribute the data to the environment 6. The environment 6 has an array of coaxial cables 4 at different locations. The connectors 2 are attachable to the coaxial cables 4. The cables 4, through use of the connectors 2, are connectable to various communication interfaces within the environment 6, such as the female interface ports 14 illustrated in FIGS. 1-2. In the examples shown, female interface ports 14 are incorporated into: (a) a signal splitter within an outdoor cable service or distribution box 32 which distributes data service to multiple homes or environments 6 close to each other; (b) a signal splitter within the outdoor cable junction box or cable junction device 10 which distributes the data service into the environment 6; (c) the set-top unit 22; (d) the TV 24; (e) wall-mounted jacks, such as a wall plate; and (f) the router 18.

Figure 2:
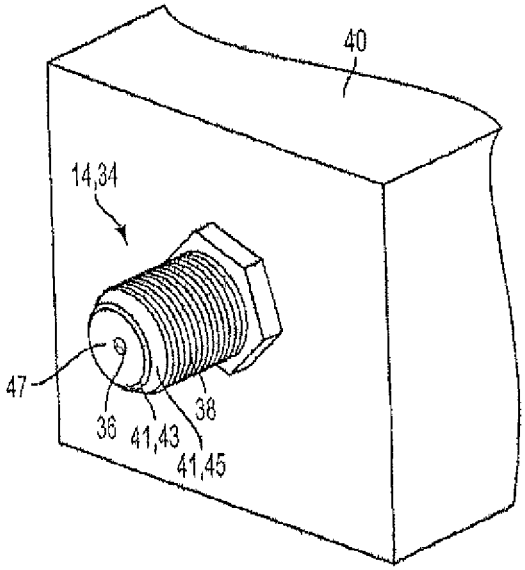
FIG. 2 is a perspective view of an exemplary interface port in accordance with various aspects of the disclosure.

In one embodiment, each of the female interface ports 14 includes a stud or jack, such as the cylindrical stud 34 illustrated in FIG. 2. The stud 34 has: (a) an inner, cylindrical wall 36 defining a central hole configured to receive an electrical contact, wire, pin, conductor (not shown) positioned within the central hole; (b) a conductive, threaded outer surface 38; (c) a conical conductive region 41 having conductive contact sections 43 and 45; and (d) a dielectric or insulation material 47.

In some embodiments, stud 34 is shaped and sized to be compatible with the F-type coaxial connection standard. It should be understood that, depending upon the embodiment, stud 34 could have a smooth outer surface. The stud 34 can be operatively coupled to, or incorporated into, a device 40 which can include, for example, a cable splitter of a distribution box 32, outdoor cable junction box 10 or service panel 12; a set-top unit 22; a TV 24; a wall plate; a modem 16; a router 18; or the junction device 33.

During installation, the installer couples a cable 4 to an interface port 14 by screwing or pushing the connector 2 onto the female interface port 34. Once installed, the connector 2 receives the female interface port 34. The connector 2 establishes an electrical connection between the cable 4 and the electrical contact of the female interface port 34.

Figure 4:
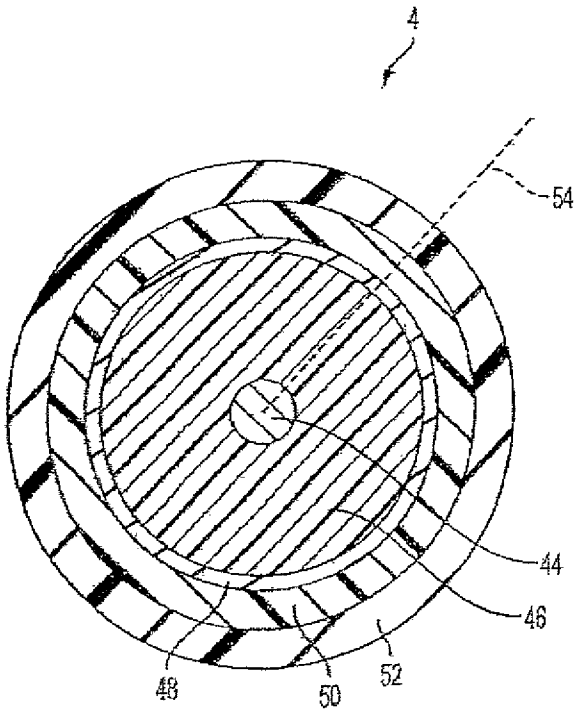
FIG. 4 is a cross-sectional view of the exemplary coaxial cable of FIG. 3.
Figure 3:
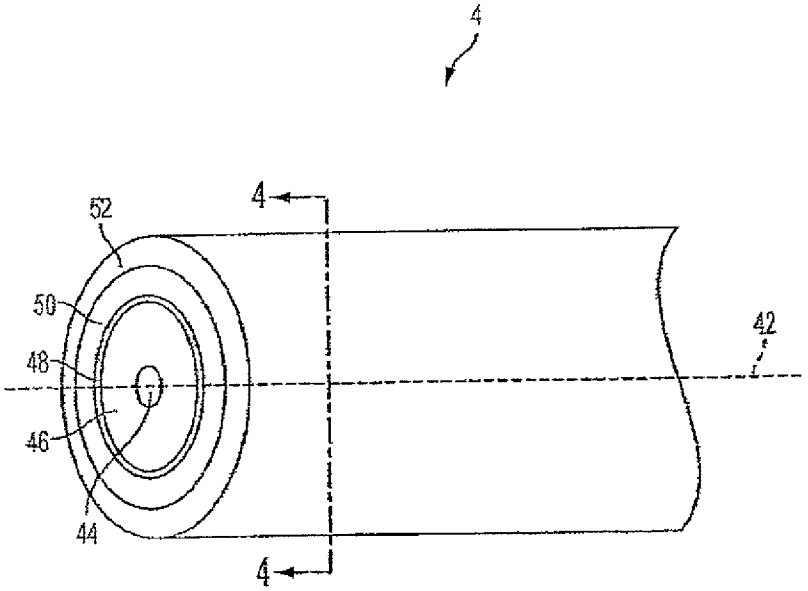
FIG. 3 is a perspective view of an exemplary coaxial cable in accordance with various aspects of the disclosure.
Figure 5:
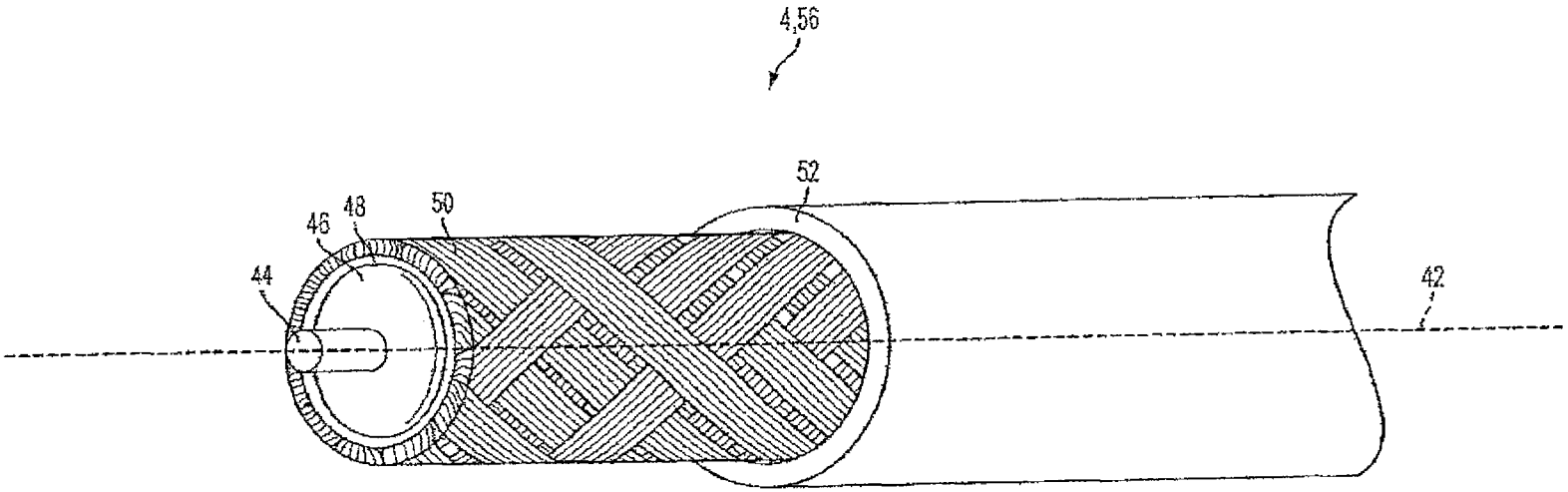
FIG. 5 is a perspective view of an exemplary prepared end of the exemplary coaxial cable of FIG. 3.

Referring to FIGS. 3-5, the coaxial cable 4 extends along a cable axis or a longitudinal axis 42. In one embodiment, the cable 4 includes: (a) an elongated center conductor or inner conductor 44; (b) an elongated insulator 46 coaxially surrounding the inner conductor 44; (c) an elongated, conductive foil layer 48 coaxially surrounding the insulator 46; (d) an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in some embodiments, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

In the embodiment illustrated in FIG. 3, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, the connector 2 electrically grounds the outer conductor 50 of the coaxial cable 4. The conductive foil layer 48, in one embodiment, is an additional, tubular conductor which provides additional shielding of the magnetic fields. In one embodiment, the jacket 52 has a protective characteristic, guarding the cable's internal components from damage. The jacket 52 also has an electrical insulation characteristic.

Referring to FIG. 5, in one embodiment an installer or preparer prepares a terminal end 56 of the cable 4 so that it can be mechanically connected to the connector 2. To do so, the preparer removes or strips away differently sized portions of the jacket 52, outer conductor 50, foil 48 and insulator 46 so as to expose the side walls of the jacket 52, outer conductor 50, foil layer 48 and insulator 46 in a stepped or staggered fashion. In the example shown in FIG. 5, the prepared end 56 has a two step-shaped configuration. In some embodiments, the prepared end has a three step-shaped configuration (not shown), where the insulator 46 extends beyond an end of the foil 48 and outer conductor 50. At this point, the cable 4 is ready to be connected to the connector 2.

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50 and the jacket 52 can vary based upon parameters corresponding to broadband communication standards or installation equipment.

Figure 6:
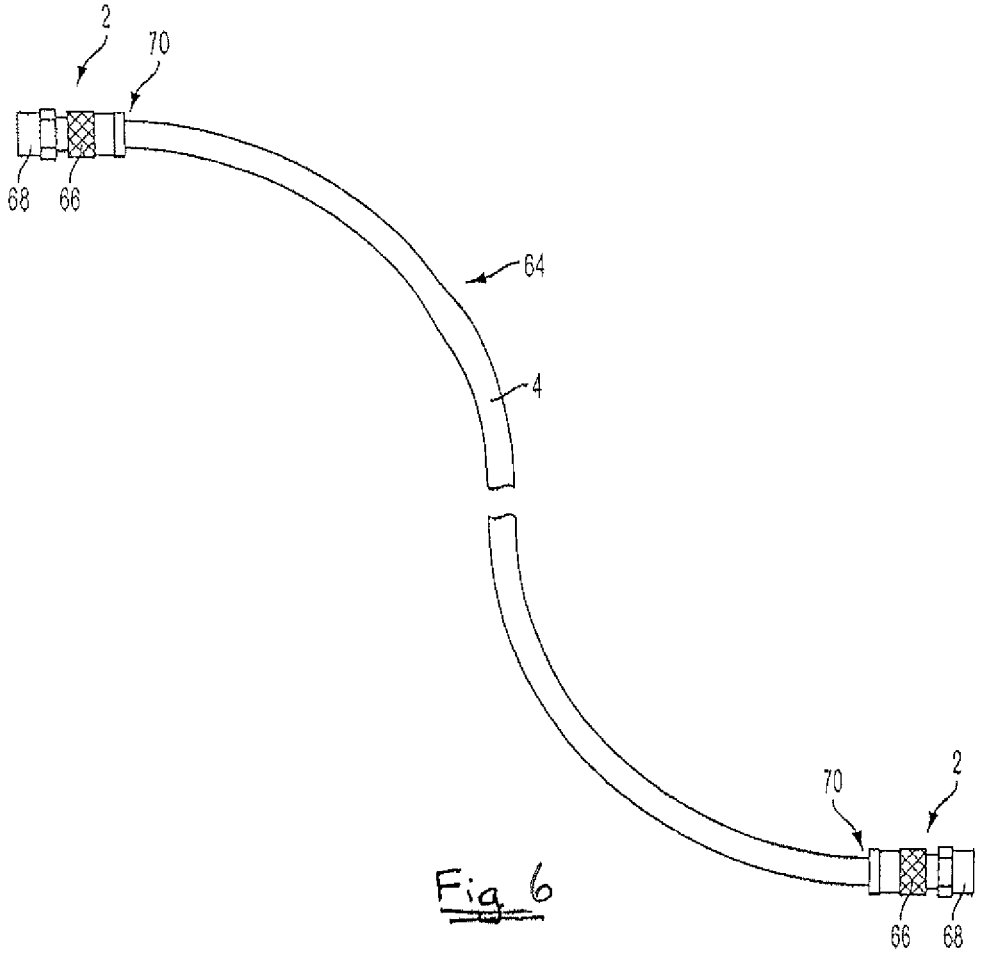
FIG. 6 is a top view of one embodiment of a coaxial cable jumper or cable assembly which is configured to be operatively coupled to the multichannel data network.

In one embodiment illustrated in FIG. 6, a cable jumper or cable assembly 64 includes a combination of the connector 2 and the cable 4 attached to the connector 2. In this embodiment, the connector 2 includes a connector body or connector housing 66 and a fastener or coupler 68, such as a threaded nut, which is rotatably coupled to the connector housing 66. The cable assembly 64 has, in one embodiment, connectors 2 on both of its ends 70. In some embodiments, the cable assembly 64 may have a connector 2 on one end and either no connector or a different connector at the other end. Preassembled cable jumpers or cable assemblies 64 can facilitate the installation of cables 4 for various purposes.

Figure 7:
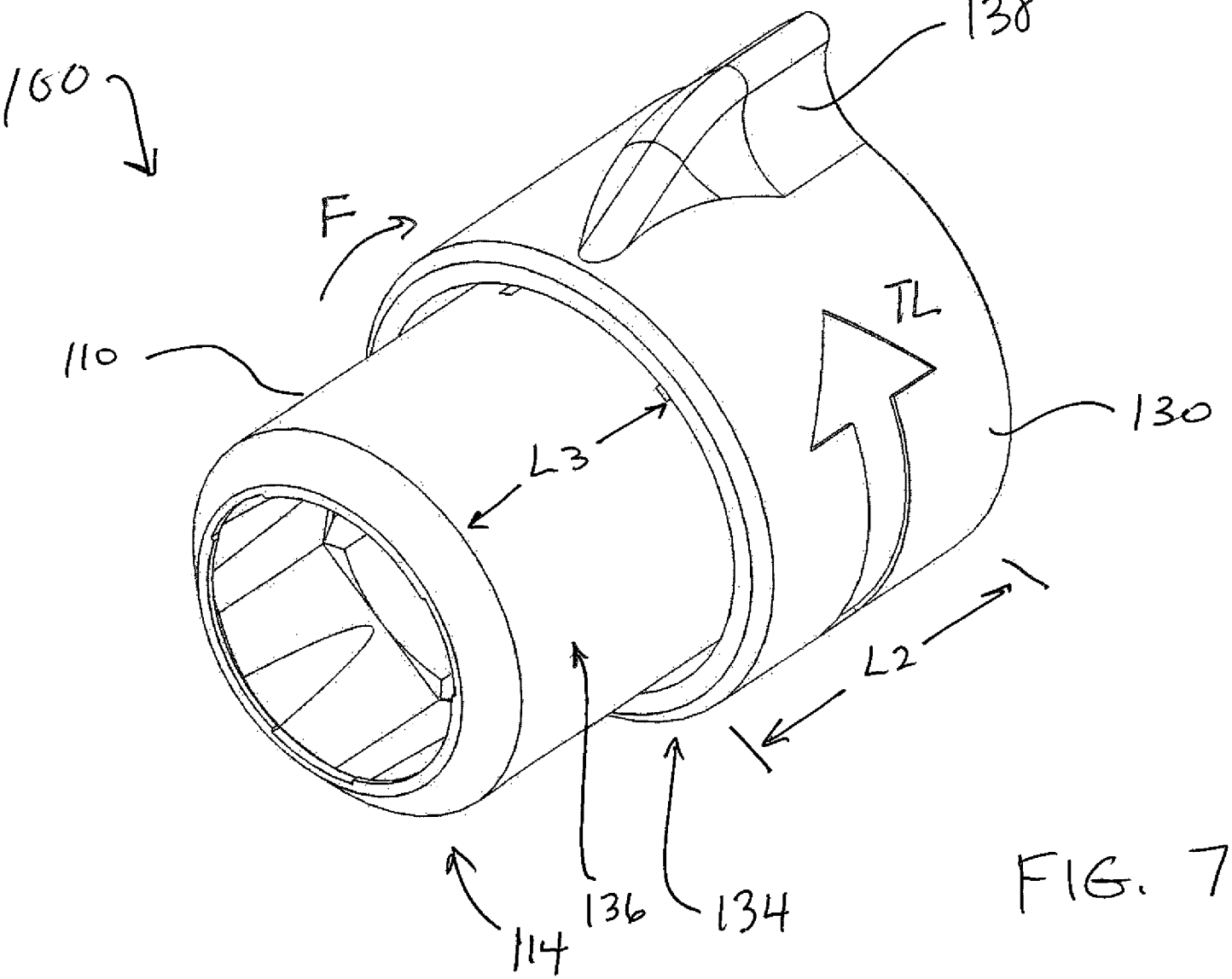
FIG. 7 is a rear perspective view of an exemplary torque-limiting torque sleeve in accordance with various aspects of the disclosure.
Figure 8:
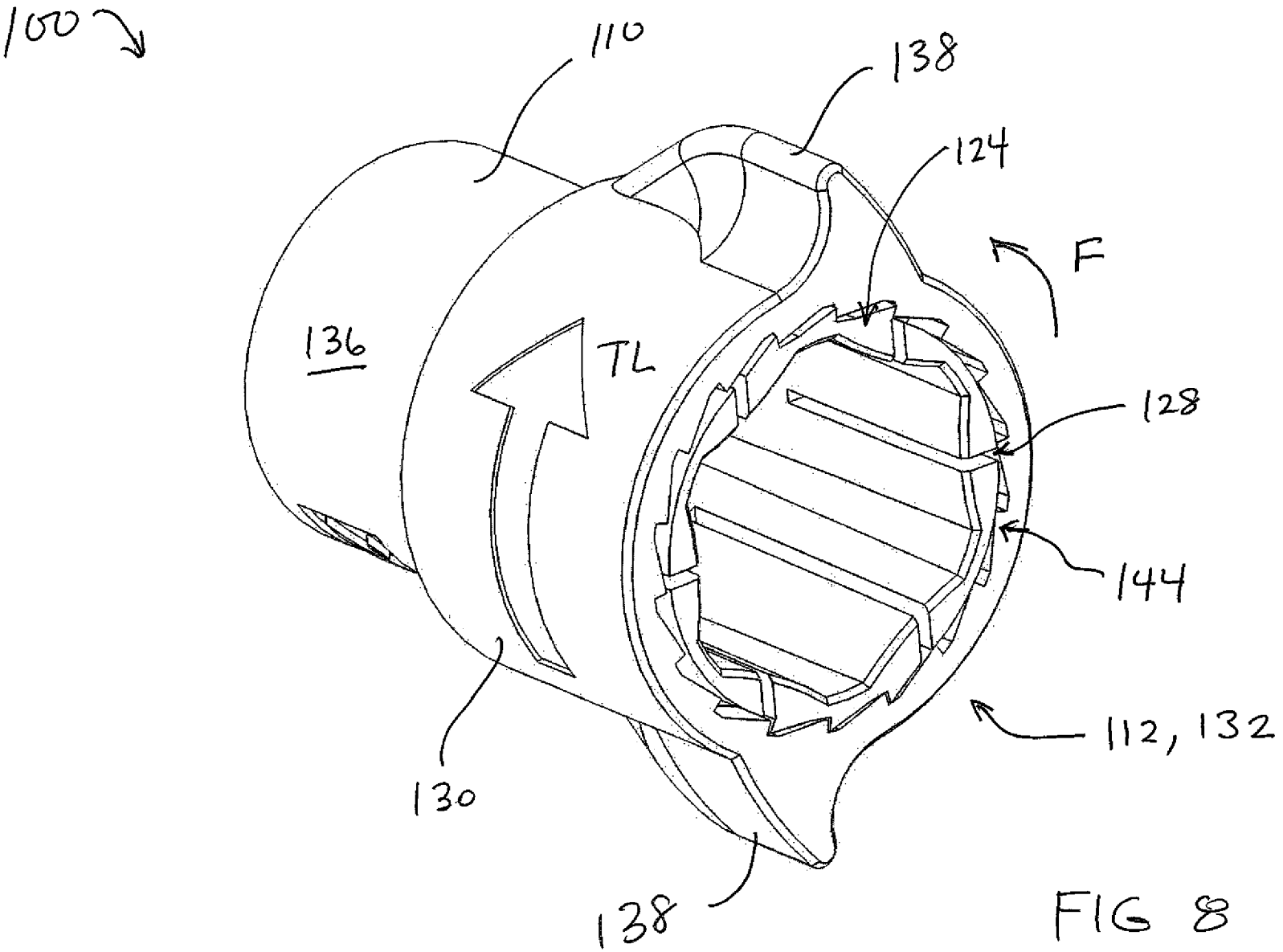
FIG. 8 is a front perspective view of the exemplary torque-limiting torque sleeve of FIG. 7.
Figure 9:
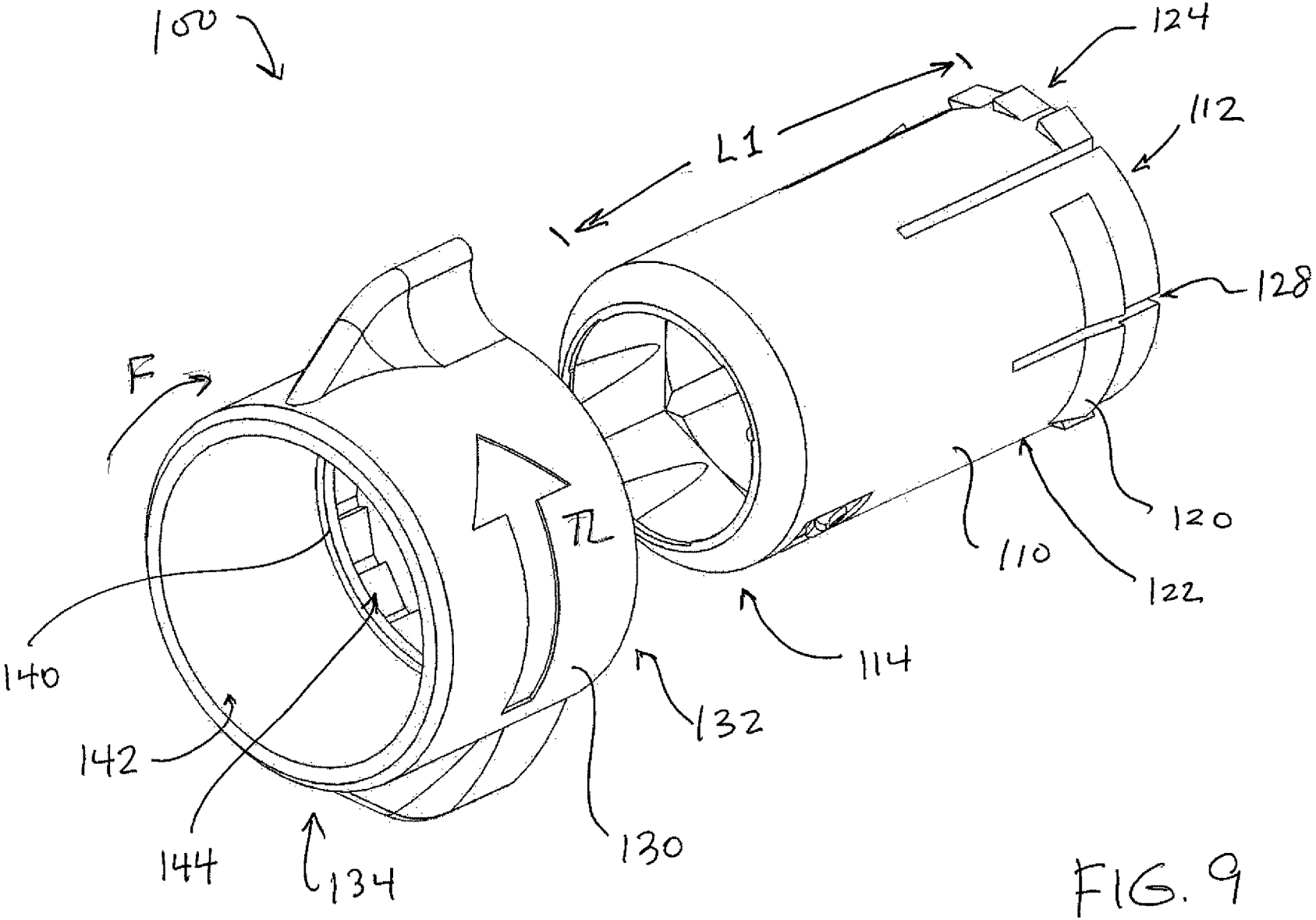
FIG. 9 is an exploded view of the exemplary torque-limiting torque sleeve of FIG. 7.

Referring to FIGS. 7-12, various embodiments of torque limiting sleeves 100, 1000 for connectors are described. As shown in FIGS. 7-9, the torque limiting sleeve 100 includes an inner member 110 and an outer member 130. The inner member 110 includes a first end 112 configured to be coupled to a nut of a connector (not shown). Alternatively, the inner member 110 may be integrally coupled with the nut, for example, by molding the inner member 110 over the nut. The inner member 110 has an axial length L1 extending from the first end 112 to an opposite second end 114. The length L1 of the inner member 110 provides a larger area for a user to grip as compared with an axial length of a nut.

The outer member 130 includes a first end 132 configured to overlie the first end 112 of the inner member 110. The outer member 130 has an axial length L2 extending form the first end 132 to an opposite second end 134. The length L2 is shorter than the length L1 such that when the outer member 130 is coupled with the inner member 110 such that the first end 132 overlies the first end 112, an exposed portion 136 of the inner member 110 extends from the second end 134 of the outer member 130. The exposed portion 136 has a length L3. The outer member 130 may also include one or more torque-enhancing members 138 extending outward from an outer surface of the outer member 130 and configured to be gripped by a user, for example, when rotating the outer member to tighten and/or loosen the coupler on the interface port.

The inner and outer members 110, 130 are configured to be coupled with one another such that the outer member 130 is fixed relative to the inner member 110 in the axial direction of their lengths L1, L2. As best illustrated in FIG. 9, the outer member 130 may be fixed relative to the inner member 110 in the axial direction by an inwardly projecting ridge 140 that extends from an inner surface 142 of the outer member 130 and cooperates that one or more outward projecting structures 120 that extend from an outer surface 122 of the inner member 110. It should be appreciated that any conventional means including, for example, an integral snap latch, a retainer ring, press-fit collars or bushings, or the like may be implemented for axially fixing the outer member 130 relative to the inner member.

When the inner and outer members 110, 130 are coupled with one another in the axially-fixed relationship, the outer member 130 is able to rotate in a first direction TL relative to the inner member 110 in a torque-limited relationship and in a second direction F in a rigid or fixed relationship with respect to the inner member 110. It should be appreciated that the inner and outer member 110, 130 may be reconfigured such that the first direction TL and the second direction F are reversed. As best illustrated in FIG. 9, the inner member 110 may include a first torque limiting feature 124 configured to cooperate with a second torque limiting feature 144 of the outer member 130.

In one exemplary embodiment, the first and second torque limiting features 124, 144 may be configured as cooperating pairs of ramped surfaces or teeth, with one side of the ramped surfaces being configured to predetermine the torque necessary to radially deflect one or both of the ramped surfaces in a radial direction so that the first and second members 110, 130 can rotate relative to one another when the predetermined torque is exceeded. In some embodiments, the inner member 110 may include one or more longitudinal slots 128 to permit radial deflection of the ramped surfaces when the predetermined torque is exceeded. The other side of the ramped surfaces may be angled squarely, or nearly squarely, so that the inner and outer members 130 are fixed for rotation in the second direction F. It should be appreciated that the torque limiting feature may be achieved by other conventional means including, but not limited to, rounded detents or even mere frictional engagement between the inner and outer member 110, 130.

In operation, the inner member 110 is coupled with a nut (or integrally projects from the nut) and extends rearward to provide a large gripping area relative to the gripping area of the nut. The outer member 130 is mounted about only a portion of the inner member 110 and is fixed relative to the inner member 110 in the axial direction. Meanwhile, the outer member 130 is configured to rotate relative to the inner member 110 in the first direction TL in a torque-limited relationship and in a rigid or fixed relationship with respect to the inner member 110 in the opposite second direction F.

When tightening the nut on an interface port on a wall jack, video equipment, or the like, the outer member is presented to the fingers of a user for gripping purposes and enables tightening up to a pre-determined torque limit, after which the outer member 130 is configured to rotate relative to the inner member to prevent over tightening. When loosening the nut from the interface port, the outer member 130 and the inner member 110 are fixed for rotation. In the event that one or both of the torque limiting features 124, 144 becomes damaged, deformed, or defective such that rotation of the outer member 130 in the first and second directions TL, F does not tighten or loosen the nut on the interface port, the exposed length L3 of the inner member 110 is grippable by a user to tighten or loosen the nut on the interface port.

Figure 10:
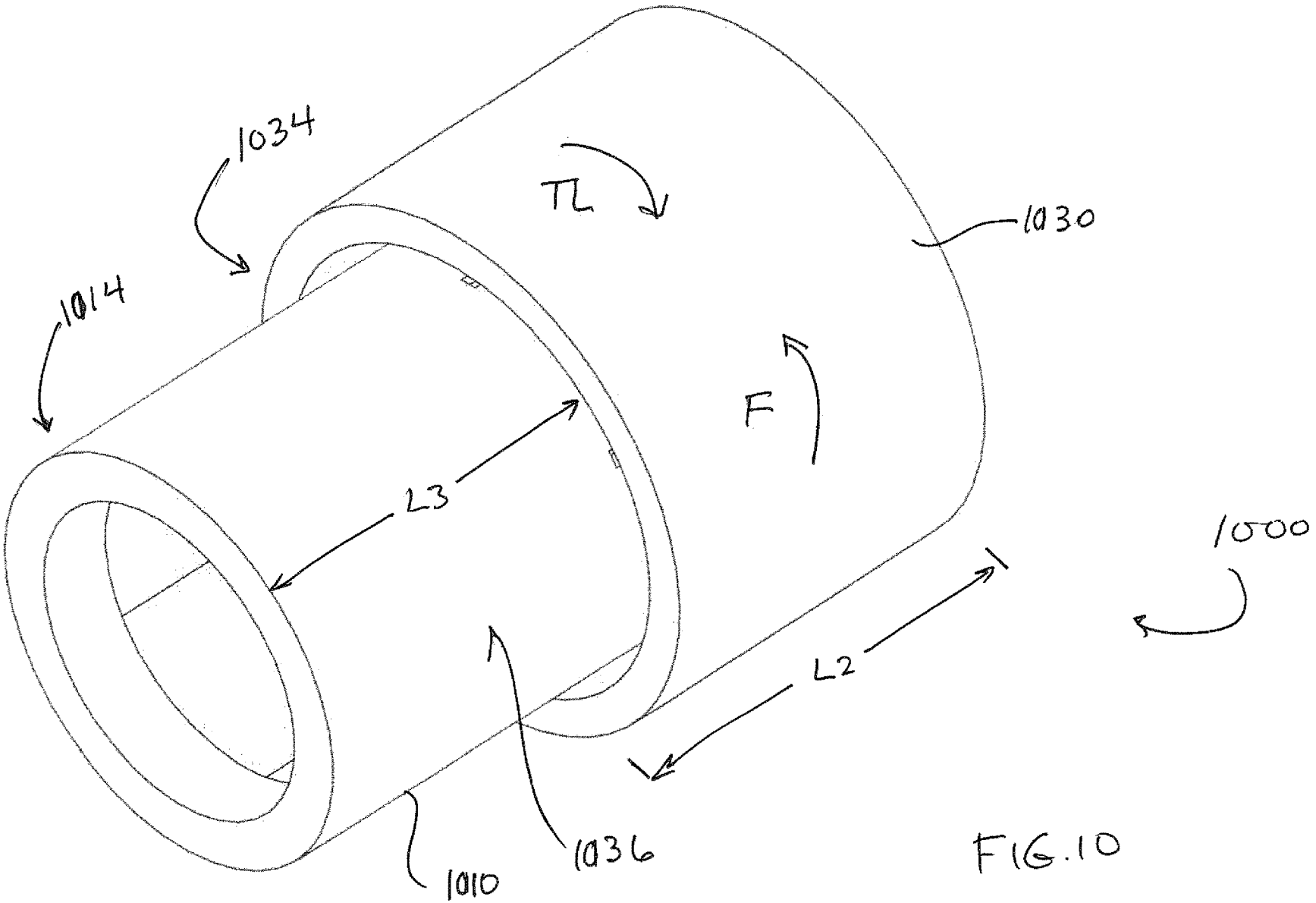
FIG. 10 is a rear perspective view of an exemplary torque-limiting torque sleeve in accordance with various aspects of the disclosure.
Figure 11:
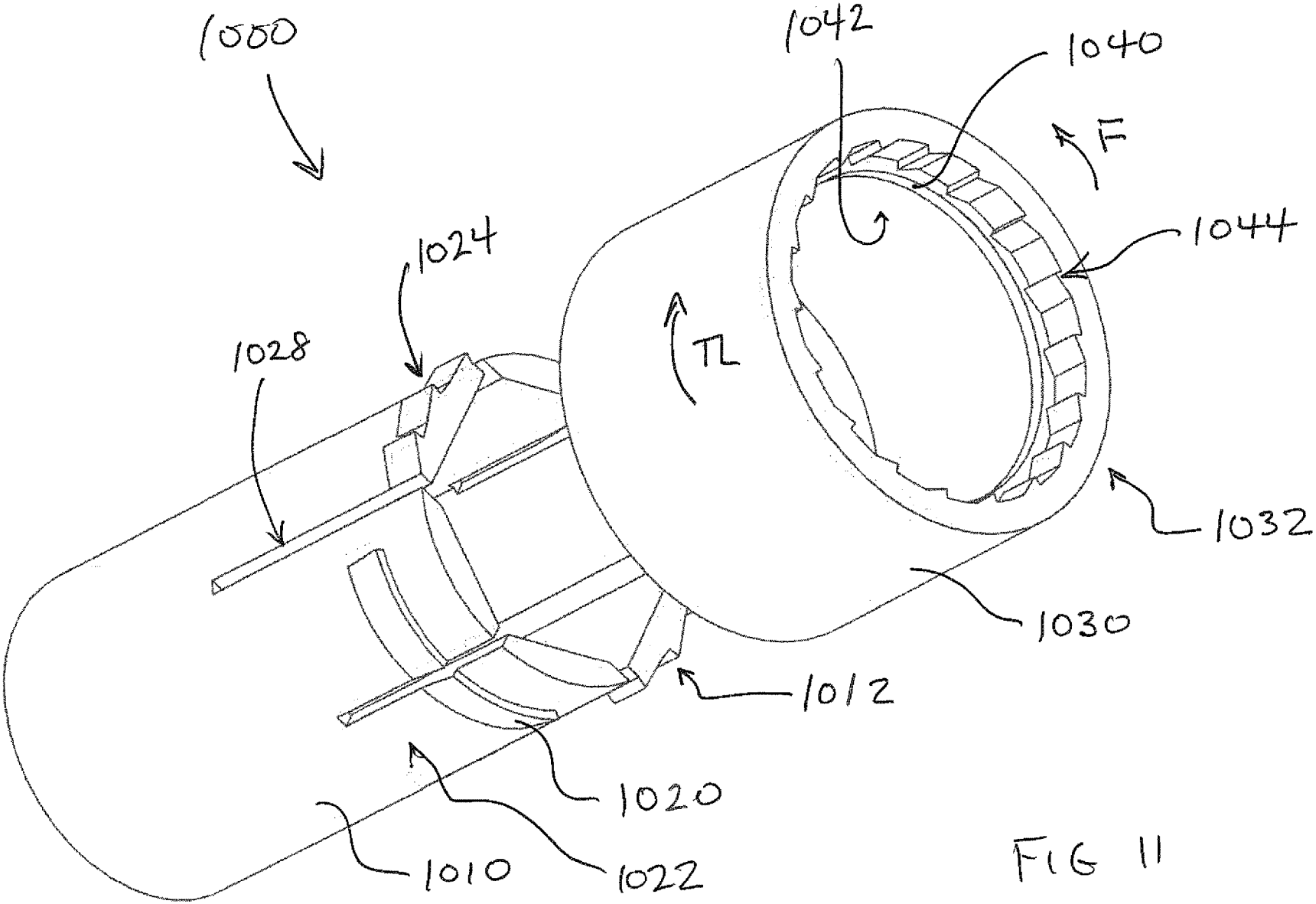
FIG. 11 is a front exploded view of the exemplary torque-limiting torque sleeve of FIG. 10.
Figure 12:
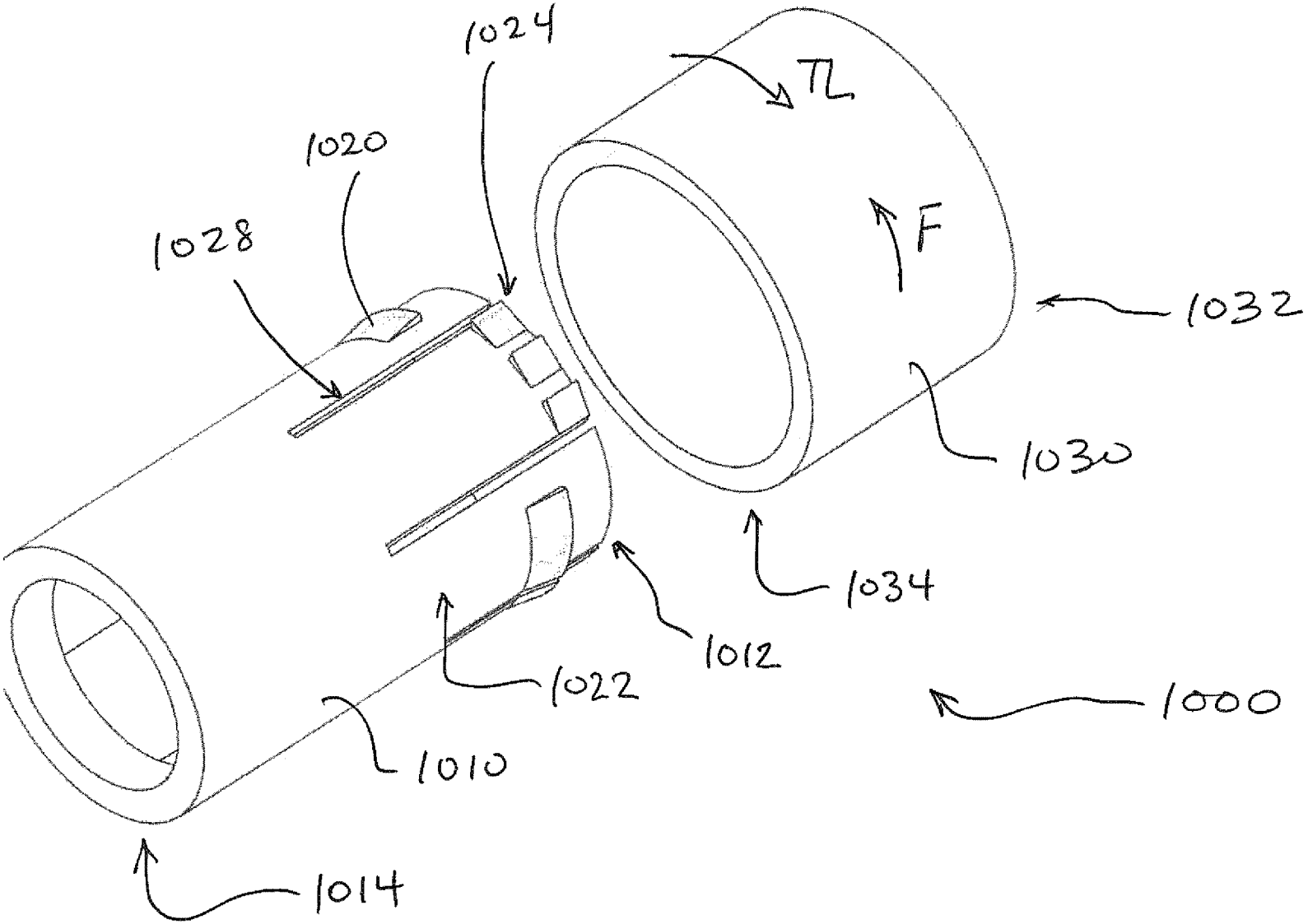
FIG. 12 is a rear exploded view of the exemplary torque-limiting torque sleeve of FIG. 10.

As shown in FIGS. 10-12, the torque limiting sleeve 1000 includes an inner member 1010 and an outer member 1030. The inner member 1010 includes a first end 1012 configured to be coupled to a nut of a connector (not shown). Alternatively, the inner member 1010 may be integrally coupled with the nut, for example, by molding the inner member 1010 over the nut. The inner member 1010 has an axial length L1 extending from the first end 1012 to an opposite second end 1014. The length L1 of the inner member 1010 provides a larger area for a user to grip as compared with an axial length of a nut.

The outer member 1030 includes a first end 1032 configured to overlie the first end 1012 of the inner member 1010. The outer member 1030 has an axial length L2 extending form the first end 1032 to an opposite second end 1034. The length L2 is shorter than the length L1 such that when the outer member 1030 is coupled with the inner member 1010 such that the first end 1032 overlies the first end 1012, an exposed portion 1036 of the inner member 1010 extends from the second end 1034 of the outer member 1030. The exposed portion 1036 has a length L3.

The inner and outer members 1010, 1030 are configured to be coupled with one another such that the outer member 1030 is fixed relative to the inner member 1010 in the axial direction of their lengths L1, L2. As best illustrated in FIG. 9, the outer member 1030 may be fixed relative to the inner member 1010 in the axial direction by an inwardly projecting ridge 1040 that extends from an inner surface 1042 of the outer member 1030 and cooperates that one or more outward projecting structures 1020 that extend from an outer surface 1022 of the inner member 1010. It should be appreciated that any conventional means including, for example, an integral snap latch, a retainer ring, press-fit collars or bushings, or the like may be implemented for axially fixing the outer member 1030 relative to the inner member.

When the inner and outer members 1010, 1030 are coupled with one another in the axially-fixed relationship, the outer member 1030 is able to rotate in a first direction TL relative to the inner member 1010 in a torque-limited relationship and in a second direction F in a rigid or fixed relationship with respect to the inner member 1010. As best illustrated in FIG. 9, the inner member 1010 may include a first torque limiting feature 1024 configured to cooperate with a second torque limiting feature 1044 of the outer member 1030.

In one exemplary embodiment, the first and second torque limiting features 1024, 1044 may be configured as cooperating pairs of ramped surfaces or teeth, with one side of the ramped surfaces being configured to predetermine the torque necessary to radially deflect one or both of the ramped surfaces in a radial direction so that the first and second members 1010, 1030 can rotate relative to one another when the predetermined torque is exceeded. In some embodiments, the inner member 1010 may include one or more longitudinal slots 1028 to permit radial deflection of the ramped surfaces when the predetermined torque is exceeded. The other side of the ramped surfaces may be angled squarely, or nearly squarely, so that the inner and outer members 1030 are fixed for rotation in the second direction F. It should be appreciated that the torque limiting feature may be achieved by other conventional means including, but not limited to, rounded detents or even mere frictional engagement between the inner and outer member 1010, 1030.

In operation, the inner member 1010 is coupled with a nut (or integrally projects from the nut) and extends rearward to provide a large gripping area relative to the gripping area of the nut. The outer member 1030 is mounted about only a portion of the inner member 1010 and is fixed relative to the inner member 1010 in the axial direction. Meanwhile, the outer member 1030 is configured to rotate relative to the inner member 1010 in the first direction TL in a torque-limited relationship and in a rigid or fixed relationship with respect to the inner member 1010 in the opposite second direction F.

When tightening the nut on an interface port on a wall jack, video equipment, or the like, the outer member is presented to the fingers of a user for gripping purposes and enables tightening up to a pre-determined torque limit, after which the outer member 1030 is configured to rotate relative to the inner member to prevent over tightening. When loosening the nut from the interface port, the outer member 1030 and the inner member 1010 are fixed for rotation. In the event that one or both of the torque limiting features 1024, 1044 becomes damaged, deformed, or defective such that rotation of the outer member 1030 in the first and second directions TL, F does not tighten or loosen the nut on the interface port, the exposed length L3 of the inner member 1010 is grippable by a user to tighten or loosen the nut on the interface port.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A torque-limiting torque sleeve comprising:

an inner sleeve having a first end configured to be coupled with a nut of a connector so as to transmit torque from the inner sleeve to the nut, the inner sleeve having a first length;

an outer sleeve configured to be coupled with the inner sleeve in a coaxial arrangement, the outer sleeve having a second length less than the first length in a longitudinal direction;

wherein when the inner and outer sleeves are coupled to one another, a first end of the outer sleeve overlies the first end of the inner sleeve, and a second end of the inner sleeve extends from the outer sleeve to provide an exposed length;

wherein the inner and outer sleeves include cooperative structures that keep the outer sleeve at a fixed position relative to the inner sleeve in the longitudinal direction;

wherein the inner and outer sleeves further include torque limiting features that cooperate with one another such that rotation of the outer sleeve in a first direction enables tightening of the nut on an interface port up to a predetermined torque limit, after which the outer sleeve is configured to rotate relative to the inner sleeve to prevent over tightening of the nut on the interface port;

wherein the torque limiting features include a first torque limiting structure extending radially outward from the inner sleeve and a second torque limiting structure extending radially inward from the outer sleeve;

wherein the torque limiting features are configured such that the inner sleeve and the outer sleeve are configured to rotate together in a first direction up to the predetermined torque limit and such that the outer sleeve is configured to rotate relative to the inner sleeve in the first direction after the nut is tightened to the predetermined torque limit; and wherein the outer sleeve and the inner sleeve are fixed for rotation in a second direction opposite to the first direction.

2. The torque-limiting torque sleeve of claim 1, wherein the exposed length of the inner sleeve is configured to be gripped by a user to tighten or loosen the nut on the interface port in the event that the torque limiting feature fails such that rotation of the outer sleeve in the first and second directions does not tighten or loosen the nut on the interface port.

3. A torque-limiting torque sleeve comprising:

an inner sleeve having a first length and being configured to be coupled with a connector so as to transmit torque from the inner sleeve to the connector;

an outer sleeve configured to be coupled with the inner sleeve in a coaxial arrangement, the outer sleeve having a second length less than the first length in a longitudinal direction;

a torque limiting feature configured to enable tightening of the connector on an interface port up to a predetermined torque limit;

wherein the torque limiting feature includes a first torque limiting structure extending radially outward from the inner sleeve and a second torque limiting structure extending radially inward from the outer sleeve;

wherein a first end of the outer sleeve is configured to overlie a first end of the inner sleeve and a second end of the inner sleeve is configured to extend from the outer sleeve when the inner and outer sleeves are coupled to one another such that the outer sleeve is fixed relative to the inner sleeve in the longitudinal direction;

wherein the torque limiting feature is configured such that the inner sleeve and the outer sleeve are configured to rotate together in a first direction up to the predetermined torque limit and such that the outer sleeve is configured to rotate relative to the inner sleeve in the first direction after the connector is tightened to the predetermined torque limit; and wherein the torque limiting feature is configured such that the inner and outer sleeves are configured to rotate together in a second direction opposite to the first direction.

4. The torque-limiting torque sleeve of claim 3, wherein the inner and outer sleeves include cooperative structures that maintain the outer sleeve at a fixed position relative to the inner sleeve in the longitudinal direction.

5. The torque-limiting torque sleeve of claim 3, wherein the torque limiting feature includes the torque limiting structures on the inner sleeve and the outer sleeve that cooperate with one another such that the rotation of the outer sleeve in the first direction enables tightening of the connector on the interface port up to the predetermined torque limit.

6. The torque-limiting torque sleeve of claim 3, wherein the outer sleeve is configured to rotate relative to the inner sleeve to prevent over tightening of the connector on the interface port after the connector is coupled to the interface port with a torque at the predetermined torque limit.

7. The torque-limiting torque sleeve of claim 3, wherein the torque limiting feature is configured such that the outer sleeve and the inner sleeve are configured to rotate together with one another in a second direction opposite to the first direction.

8. The torque-limiting torque sleeve of claim 3, wherein a length of the inner sleeve that extends from the outer sleeve is configured to be gripped by a user to tighten or loosen the nut on the interface port in the event that the torque limiting feature fails such that rotation of the outer sleeve in the first and second directions does not tighten or loosen the nut on the interface port.

9. A torque-limiting torque sleeve, comprising:

an inner member configured to be coupled with a connector so as to transmit torque from the inner sleeve to the connector;

an outer member configured to be coupled to the inner member such that the outer member is fixed relative to the inner member in the longitudinal direction, a first end of the outer member overlies a first end of the inner member, and a second end of the inner member extends from the outer member;

a torque limiting feature configured to enable tightening of the connector on an interface port up to a predetermined torque limit;

wherein the torque limiting feature includes a first torque limiting structure extending radially outward from the inner member and ii second torque limiting structure extending radially inward from the outer member; and wherein the torque limiting feature is configured such that the inner and outer members are configured to rotate together in a first direction up to the predetermined torque limit and such that the outer member is configured to rotate relative to the inner member in the first direction after the connector is tightened to the predetermined torque limit.

10. The torque-limiting torque sleeve of claim 9, wherein:

the inner member has a first length; and the outer member has a second length less than the first length in a longitudinal direction.

11. The torque-limiting torque sleeve of claim 9, wherein at least one of the inner and outer members includes a structure that maintains the outer member at a fixed position relative to the inner member in the longitudinal direction.

12. The torque-limiting torque sleeve of claim 9, wherein the outer member is configured to rotate relative to the inner member in the first direction to prevent over tightening of the connector on the interface port after the connector is coupled to the interface port with a torque at the predetermined torque limit.

13. The torque-limiting torque sleeve of claim 9, wherein the torque limiting feature is configured such that the outer member and the inner member are configured to rotate together with one another in the second direction.

14. The torque-limiting torque sleeve of claim 9, wherein a length of the inner sleeve that extends from the outer sleeve is configured to be gripped by a user to tighten or loosen the nut on the interface port in the event that the torque limiting feature fails such that rotation of the outer sleeve in the first and second directions does not tighten or loosen the nut on the interface port.

15. The torque-limiting torque sleeve of claim 9, wherein the inner and outer sleeves are coupled to one another such that the outer sleeve is fixed relative to the inner sleeve in the longitudinal direction.

16. A torque-limiting torque sleeve comprising:

an inner sleeve having a first length and being configured to be coupled with a connector so as to transmit torque from the inner sleeve to the connector;

an outer sleeve configured to be coupled with the inner sleeve in a coaxial arrangement, the outer sleeve having a second length less than the first length in a longitudinal direction;

a torque limiting feature configured to enable tightening of the connector on the interface port up to the predetermined torque limit;

wherein the torque limiting feature includes a first torque limiting structure extending radially outward from the inner sleeve and a second torque limiting structure extending radially inward from the outer sleeve;

wherein a first end of the outer sleeve is configured to overlie a first end of the inner sleeve and a second end of the inner sleeve is configured to extend from the outer sleeve when the inner and outer sleeves are coupled to one another wherein the torque limiting feature is configured such that the inner sleeve and the outer sleeve are configured to rotate together in a first direction up to the predetermined torque limit and such that the outer sleeve is configured to rotate relative to the inner sleeve in the first direction after the connector is tightened to the predetermined torque limit; and wherein the torque limiting feature is configured such that the inner and outer sleeves are configured to rotate together in a second direction opposite to the first direction.

17. The torque-limiting torque sleeve of claim 16, wherein the inner and outer sleeves include cooperative structures that maintain the outer sleeve at a fixed position relative to the inner sleeve in the longitudinal direction.

18. The torque-limiting torque sleeve of claim 16, wherein the outer sleeve is configured to rotate relative to the inner sleeve to prevent over tightening of the connector on the interface port after the connector is coupled to the interface port with a torque at the predetermined torque limit.

19. The torque-limiting torque sleeve of claim 16, wherein the torque limiting feature is configured such that the outer sleeve and the inner sleeve are configured to rotate together with one another in a second direction opposite to the first direction.

20. The torque-limiting torque sleeve of claim 16, wherein the exposed length of the inner sleeve is configured to be gripped by a user to tighten or loosen the nut on the interface port in the event that the torque limiting feature fails such that rotation of the outer sleeve in the first and second directions does not tighten or loosen the nut on the interface port.

21. The torque-limiting torque sleeve of claim 16, wherein the inner and outer sleeves are coupled to one another such that the outer sleeve is fixed relative to the inner sleeve in the longitudinal direction.

* * * * *